US008985812B2

(12) United States Patent
Hossler

(10) Patent No.: US 8,985,812 B2
(45) Date of Patent: Mar. 24, 2015

(54) REAR ILLUMINATED PANEL

(71) Applicant: Tiffin Scenic Studios, Inc., Tiffin, OH (US)

(72) Inventor: Brad E. Hossler, Tiffin, OH (US)

(73) Assignee: Tiffin Scenic Studios, Inc., Tiffin, OH (US)

( * ) Notice: Subject to any disclaimer, the term of this patent is extended or adjusted under 35 U.S.C. 154(b) by 233 days.

(21) Appl. No.: 13/621,944

(22) Filed: Sep. 18, 2012

(65) Prior Publication Data

US 2013/0083523 A1 Apr. 4, 2013

Related U.S. Application Data

(60) Provisional application No. 61/537,870, filed on Sep. 22, 2011, provisional application No. 61/611,860, filed on Mar. 16, 2012.

(51) Int. Cl.

| | |
|---|---|
| ***F21S 4/00*** | (2006.01) |
| ***F21V 21/00*** | (2006.01) |
| ***F21V 1/00*** | (2006.01) |
| ***F21V 15/01*** | (2006.01) |
| ***F21V 21/112*** | (2006.01) |
| *F21S 2/00* | (2006.01) |
| *F21V 3/04* | (2006.01) |
| *F21V 17/00* | (2006.01) |
| *F21W 131/406* | (2006.01) |
| *F21Y 101/02* | (2006.01) |
| *F21Y 103/00* | (2006.01) |
| *F21Y 113/00* | (2006.01) |
| *G09F 13/04* | (2006.01) |
| *G09F 13/22* | (2006.01) |

(52) U.S. Cl.

CPC . *F21S 4/003* (2013.01); *F21V 1/00* (2013.01); *F21V 15/013* (2013.01); *F21V 21/112* (2013.01); *F21S 2/00* (2013.01); *F21V 3/0436* (2013.01); *F21V 17/002* (2013.01); *F21W 2131/406* (2013.01); *F21Y 2101/02* (2013.01); *F21Y 2103/003* (2013.01); *F21Y 2113/007* (2013.01); *G09F 2013/0459* (2013.01); *G09F 2013/222* (2013.01)

USPC ..... 362/249.02; 362/223; 362/311.02; 362/330

(58) Field of Classification Search

CPC ..... F21S 4/003; F21S 4/008; F21V 15/013; F21V 17/002; F21Y 2103/003; G06F 2013/222

USPC ..... 362/217.01–217.02, 217.1–217.17, 362/223–225, 249.02, 311.02, 330, 612

See application file for complete search history.

(56) References Cited

U.S. PATENT DOCUMENTS

2011/0176308 A1* 7/2011 Wu et al. ..... 362/247

*Primary Examiner* — Jason Moon Han

(74) *Attorney, Agent, or Firm* — Barnes & Thornburg LLP; Alice O. Martin

(57) ABSTRACT

A rear illuminated panel includes a base member having first and second opposing sides and a pair of guide grooves formed on the first side of the base member. The panel further includes a translucent thermoplastic sheet of material having rubber channel strips on opposing longitudinal sides of the sheet of material. The sheet of material is disposed within the guide grooves of the base member such that channel strips prevent vibration of the sheet of material within the guide grooves. The panel still further includes an LED strip having a plurality of LEDs and disposed within a cavity formed by the base member and the sheet of material, wherein light from the LEDs illuminates the sheet of material. The second opposing side of the base panel is adapted to be fastened to a structure. Exemplary suitable structures include a locking rail and an index light.

2 Claims, 12 Drawing Sheets

REAR ILLUMINATED PANEL

RELATED APPLICATIONS

This application claims the benefit of U.S. Provisional Application Ser. No. 61/537,870 filed Sep. 22, 2011, and U.S. Provisional Application Ser. No. 61/611,860, filed Mar. 16, 2012, the disclosures of which are hereby incorporated by reference in their entireties.

FIELD OF THE INVENTION

The present invention is directed to an illuminated panel for use with a support structure, and more particularly to an illuminated panel for use in theater products and the like.

BACKGROUND

In theater productions, a locking rail is a piece of equipment that stretches a depth of a stage, along side of a stage, and/or along the front or back of a stage, and is located at the stage floor or on a fly gallery. The locking rail generally contains rope locks that are attached at approximately six inch intervals. These locks control the battens that run up, down, and over the stage, wherein the battens contain lights, scenery, drapery, etc. During performances, the battens need to be moved up and down, but during such performances, the lighting in the theater is oftentimes dim, and spotlights are utilized to highlight cast members and/or scenery to highlight portions of the production. Due to the dimming of many lights in the theater, it is oftentimes difficult to see behind scenery, and thus, it is difficult for users to determine which rope lock they need to open. During a performance, operation of an incorrect rope lock can not only be disastrous in that it can ruin the performance, but can also injure a performer, stagehand, bystander, or audience member.

As seen in FIGS. 1 and 2, lighting systems 8 incorporating a plurality of lights 10, such as 40 or 60 watt light bulbs, are routinely used to provide guidance to persons behind scenery or on a portion of a stage in a theater production. The systems 8 generally include a rectangular frame 11 for securing and holding the lights 10, which extend outwardly of the frame 11. The frame 11 also houses wiring and other electronic circuitry 12. A housing 13 extends outwardly from the frame 11 to cover at least a portion of the lights 10, wherein the housing 13 includes an opening 14 for light to emanate therethrough. Eye bolts, hooks, or other attachment mechanisms 15 extend from a side of the frame 11 opposite the housing 13 for hanging the system 8 from a structure. Index cards with writing thereon are utilized to provide directions, indicate location, or provide other information to someone behind the scenes. Lighting systems such as that shown in FIGS. 1 and 2 are difficult and time-consuming to use and allow the lighting to bleed into the performance area, and therefore, are not desired for many theater performances.

SUMMARY

In illustrative embodiments, an illuminated panel includes a base member having first and second opposing sides and a pair of guide grooves formed on the first side of the base member. The panel further includes a translucent thermoplastic sheet of material having rubber channel strips on opposing longitudinal sides of the sheet of material. The sheet of material is disposed within the guide grooves of the base member such that channel strips prevent vibration of the sheet of material within the guide grooves. The panel still further includes an LED strip having a plurality of LEDs and disposed within a cavity formed by the base member and the sheet of material, wherein light from the LEDs illuminates the sheet of material. The second opposing side of the base panel is adapted to be fastened to a structure. Suitable structures include a locking rail and an index light.

In further illustrative embodiments, an illuminated panel includes a base member having first and second opposing sides and a pair of grooves formed on the first side of the base member. The illuminated panel further includes a translucent sheet of material disposed within the grooves of the base member. An LED strip having a plurality of LEDs is disposed within a cavity formed by the base member and the sheet of material, wherein light from the LEDs illuminates the sheet of material. A light directing wall extends from the first side of the base member for directing light emitting by the LEDs.

In additional illustrative embodiments, an illuminated panel includes a support structure attached to a beam or other support and having a panel for illumination. The illuminated panel further includes a housing having a first wall attached to the support structure, a second wall extending at an angle with respect to the first wall, and a third wall extending at an angle from the second wall. The panel for illumination and the second and third walls form a cavity. An LED strip having a plurality of LEDs is disposed within the cavity for illumination of the panel for illumination.

BRIEF DESCRIPTION OF THE DRAWINGS

Other aspects and advantages of the present disclosure will become apparent upon consideration of the following detailed description, wherein similar structures have like or similar reference numerals.

DETAILED DESCRIPTION

The present disclosure is directed to a rear illuminated panel for attachment to a locking rail in one embodiment and an index light in another embodiment. Although the rear illuminated panels disclosed herein may be embodied in many different forms, several specific embodiments are discussed herein with the understanding that the present disclosure is to be considered only as an exemplification of the principles of the disclosure, and it is not intended to limit the disclosure to the embodiments illustrated.

Figure 1:
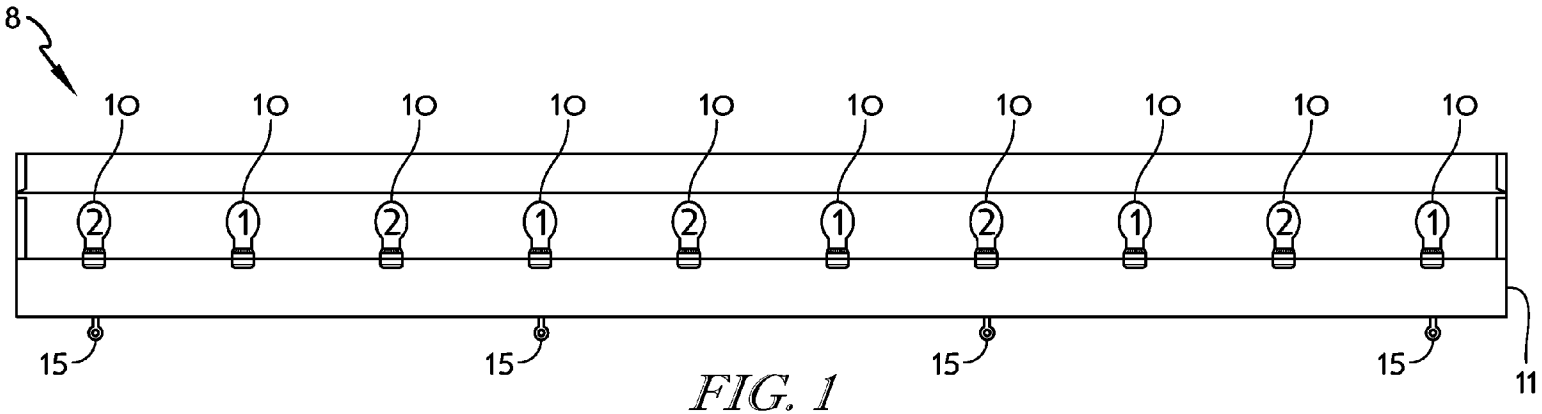
FIG. 1 (Prior Art)
FIG. 1 is a front elevational view of a prior art lighting system.
Figure 2:
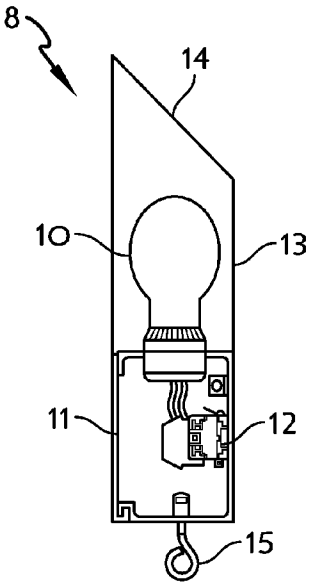
FIG. 2 (Prior Art)
FIG. 2 is a side elevational view of the prior art lighting system taken generally from the lines 2-2 of FIG. 1.
Figure 3:
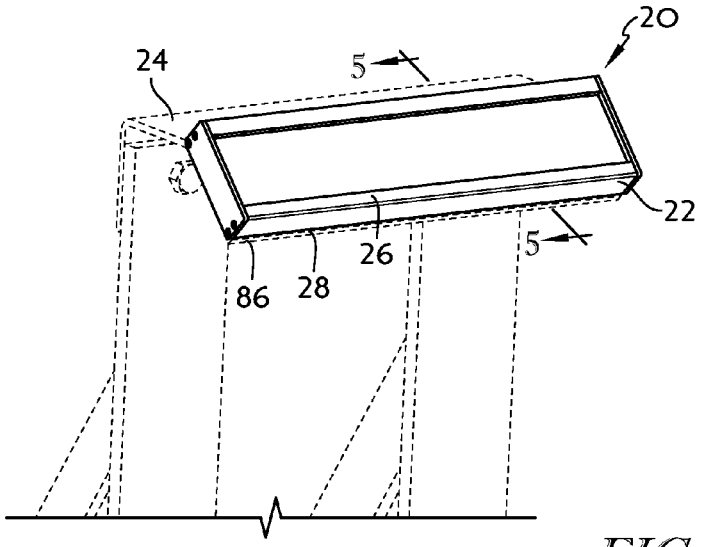
FIG. 3 is a top isometric view of a rear illuminated panel of the present disclosure attached to a support structure (in particular, a locking rail)
Figure 4:
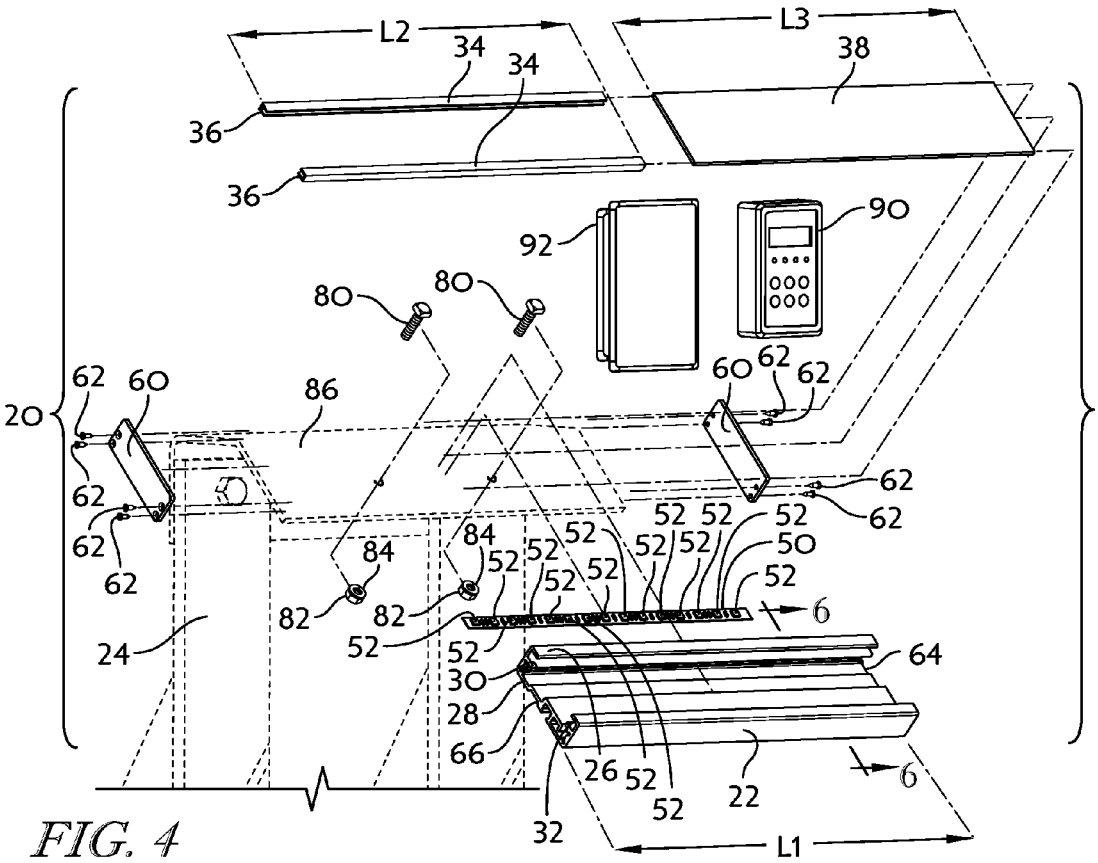
FIG. 4 is an exploded view of the rear illuminated panel of FIG. 1.
Figure 5:
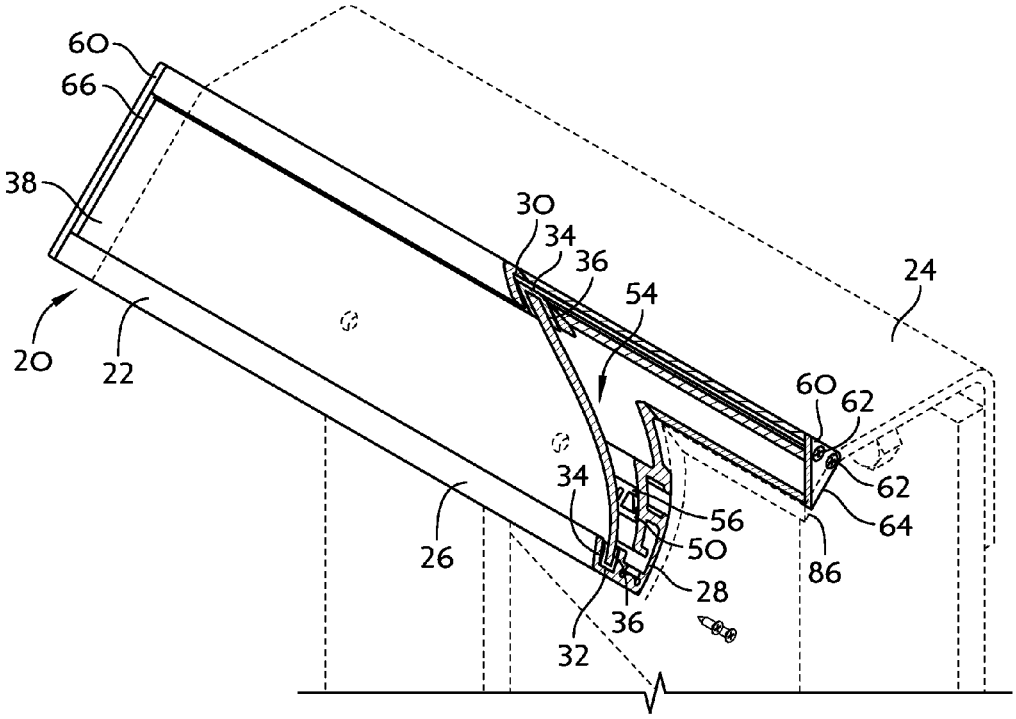
FIG. 5 is a partial cross-sectional view taken generally along the lines 3-3 of FIG. 1 with portions of the rear illuminated panel removed for clarity.

Referring to the drawings, FIGS. 3-5 depict a rear illuminated panel 20 having a base member 22 that is formed of an aluminum extrusion. While aluminum is used for the base member 22, those skilled in the art would understand that any other extrudable or non-extrudable materials may be utilized, for example, plastic, steel, and the like, or combinations of two or more materials. The base member 22 includes a plurality of grooves and cavities for retention of various components of the rear illuminated panel 20 and attachment of the panel 20 to one or more different support structures 24 (FIGS. 3 and 5), such as an index strip or a locking rail, which will be discussed in detail hereinafter.

As seen in FIG. 4, the base member 22 includes first and second lateral sides 26, 28 with an opposing pair of guide grooves 30, 32 being disposed on the first lateral side 26 of the base member 22 and extending an entire longitudinal length L1 of the base member 22. The rear illuminated panel 20 further includes a pair of rubber channel strips 34 that are generally U-shaped to form a channel 36 that can accommodate a sheet of translucent thermoplastic material 38, such as Plexiglas. Preferably, although not necessarily, the thermoplastic material 38 is white in color and is adapted for writing thereon with a dry erase marker or other similar writing implement. Similarly, writing on the thermoplastic material 38 may be erased and/or illuminated so that a user can easily read writing on the material 38. The thermoplastic material 38 provides an advantage over prior art systems in that index cards are no longer necessary. In prior art systems, the index cards could get lost or moved, thereby causing confusion and, possibly, mistakes.

The sheet of thermoplastic material 38 is inserted into the channels 36 formed by the rubber strips 34. Preferably, the rubber strips 34 have a length L2 that is the same as a length L3 of the sheet of thermoplastic material 38. The length L3 of the sheet of thermoplastic material 38 is also about the same as the length L1 of the base member 22. After the rubber strips 34 are attached to the sheet of thermoplastic material 38, the assembly is slid into the opposing grooves 30, 32 formed in the base member 22. In this manner, the rubber strips 34 fit within the grooves 30, 32 with little space between the strips 34 and walls forming the grooves 30, 32. In one embodiment, a friction fit is created therebetween. Further, when assembled with the base member 22, the rubber strips 34 retain the sheet of thermoplastic material 38 and position and prevent movement or vibration of the sheet of thermoplastic material 38. Although the strips 34 are shown and described as being rubber, the strips 34 may be made of any flexible, compressible material that will hold the sheet of thermoplastic material 38 in place within the grooves 30, 32. Further, the sheet of thermoplastic material 38 may be replaced by any translucent semi-rigid material that would allow a user to write on a surface of the material, as will be discussed in greater detail hereinafter. Still optionally, a diffuser and/or a gel material may be used in combination with the thermoplastic material 38 or in place of the thermoplastic material 38.

Figure 7:
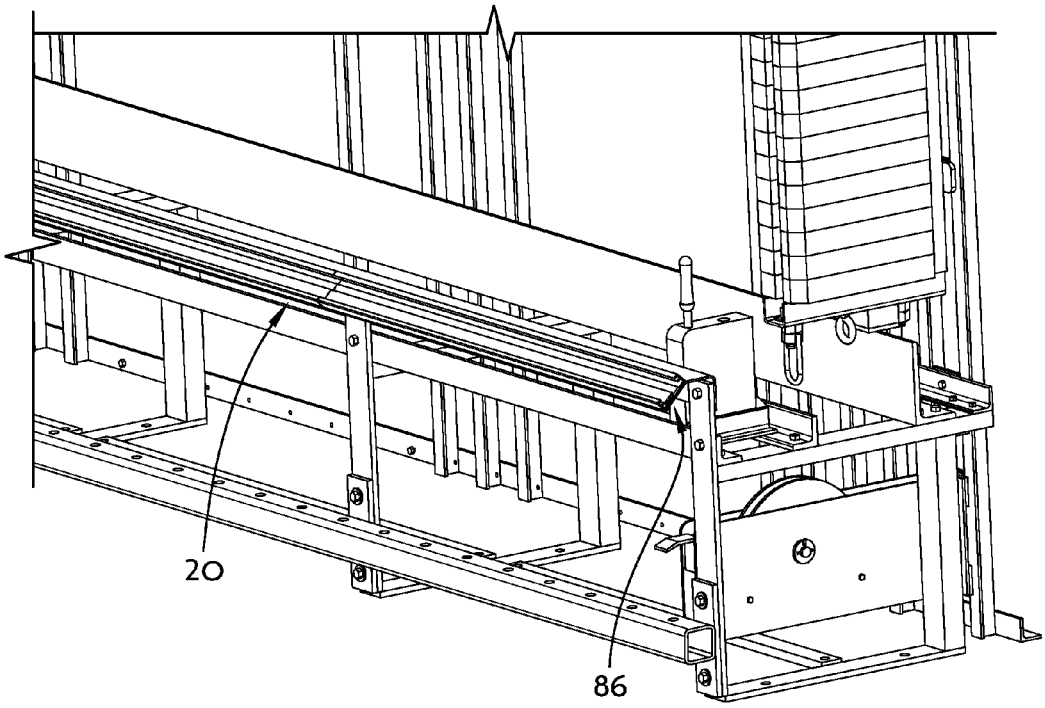
FIG. 7 is a view of the rear illuminated panel of FIG. 1 attached to the support structure (locking rail) and installed in a theater.
Figure 8:
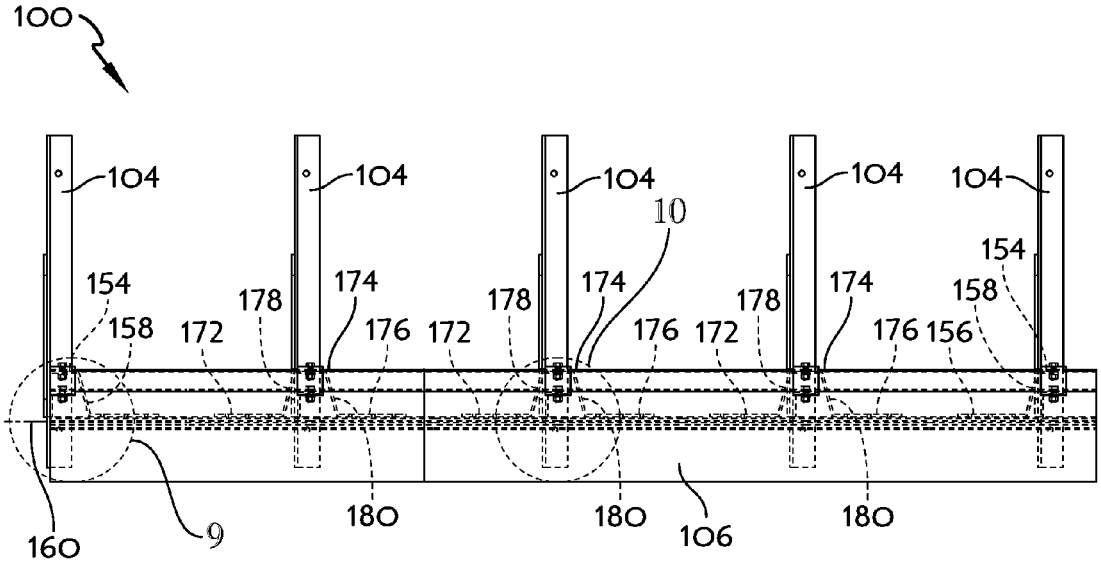
FIG. 8 is a front elevational view of the rear illuminated panel of FIG. 1 attached to a support structure (in particular, an index light)

The rear illuminated panel 20 further includes a light-emitting diode (LED) strip 50, as best seen in FIGS. 4 and 7. The strip 50 includes a plurality of LEDs 52 extending along a length of the strip 50 and the strip 50 is positioned within a cavity 54 formed after insertion of the assembly of the sheet of thermoplastic material 38 and the rubber strips 34 is inserted into the base member 22. In particular, the strip 50 is attached by adhesive, hook and loop fasteners, or any other attachment mechanism known in the art to a surface 56 within the cavity 54. Optionally, the strip 50 may be attached to any surface within the cavity 54 that would allow light emitted from the LEDs 52 to project through and illuminate the sheet of thermoplastic material 38. When the sheet of thermoplastic material 38 is illuminated, a user can view the content of what has been written on the sheet of thermoplastic material 39. This is useful in a theater setting, for example, during a performance or rehearsal to indicate to a user of a locking rail which counterweight set to operate. Optionally, light from the rear illuminated panel 20 may be utilized in any other relatively dark setting, wherein a user needs to be notified of particular directions and the user is unable to see without an illuminated panel. The benefit of this rear illuminated panel is that the light is muted and the light does not bleed into a performance area. In particular, because the rear illuminated panel may illuminate rearwardly of the performance area, as opposed to downwardly or forwardly as seen in the prior art, the light projected by the rear illuminated panel does not bleed into the performance area. In addition, the use of LEDs 52 allows for control of the amount and direction of the light emitted therefrom. In one embodiment, a subset of the LEDs 52 may be illuminated depending on the amount of light needed.

The LEDs 52 in the LED strip 50 may be all of the same color, such as white, red, blue, green, etc., but alternatively, one or more of the LEDs 52 may be tri-color (red, green, and blue) LEDs. If multiple or all tri-color LEDs are utilized, up to 16 million different colors may be utilized (e.g., using a DMX controller).

After the rubber strips 34, the sheet of thermoplastic material 38, and the LED strip 50 are mounted within the base member 22, end caps 60, preferably made of the same material as the base member 22 are attached by mounting screws 62 (which are mounted within extruded holes in the base member 22) to opposing ends 64, 66 of the base member 22, as seen in FIG. 4. The end caps 60 retain the rubber strips 34, the sheet of thermoplastic material 38, and the LED strip 50 within the base member 22, and also contain any wires or other elements disposed within cavities in the second lateral side 28 of the base member 22, as discussed below.

Figure 6:
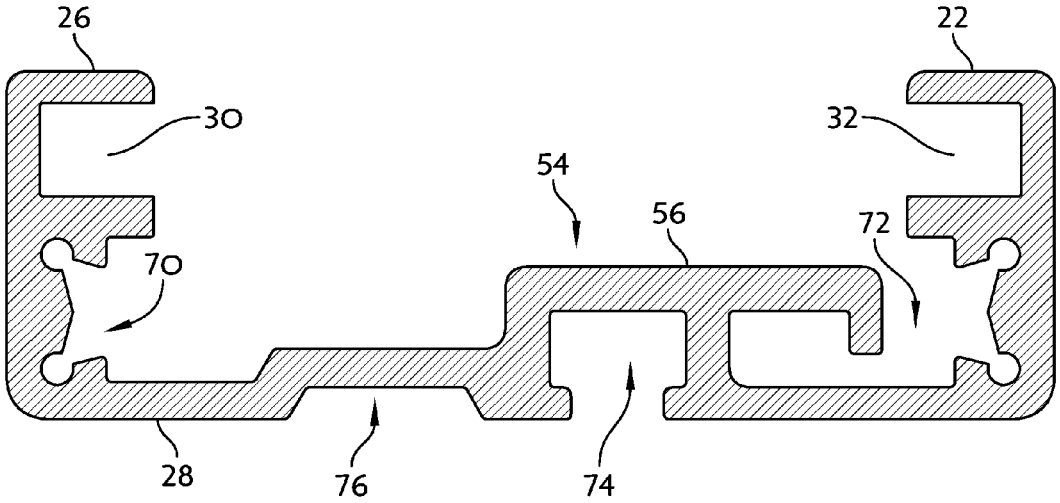
FIG. 6 is a cross-sectional view taken generally along the lines 4-4 of FIG. 2 and depicting a base member of the rear illuminated panel.

Referring to FIG. 6, the base member 22 includes cavities 70, 72 contiguous with the cavity 54. Further, the base member 22 includes a groove 76 and a generally C-shaped cavity 78 formed within the second lateral side 28. At least one of the cavities 70, 72, 74 and the groove 76 are intended to support and house wiring for providing power to the LED strip 50.

As seen in FIG. 4, square head bolts 80 in combination with nuts 82 and washers 84 are utilized to attach the rear illuminated panel 20 to a locking rail 86 of the support structure 24. Preferably, extruded holes are disposed within the locking rail 86 for insertion of the square head bolts 80. Optionally, the rear illuminated panel 20 may be attached to the lock rail 86 in any manner known in the art.

In one embodiment, as shown in FIG. 4, a programmable controller 90 is utilized to control the LEDs 52. The programmable controller 90 allows a user to remotely select a color, create a customized program for illuminating the LEDs, provide delays, dim the LEDs, and create color changing effects. The controller 90 may include any number of pre-programmed lighting effects or may allow a user to program any number of lighting effects or change lighting effects on the fly. In another embodiment, a wireless on/off and dimming switch 92 may be mounted into an electrical box that is attached to a wall, as seen in FIG. 4. Optionally, the electrical box may be provided with a manual override switch or control. In yet another embodiment, both the controller 90 and the switch 92 may be utilized. If a wireless switch 92 or other controller is utilized, cords and wires may be eliminated from the rear illuminated panel 20. The elimination of cords and wires reduces the risk of injury due to tripping over such components and provides a neater area surrounding the rear illuminated panel 20.

In a further embodiment, as detailed in FIGS. 8-12, the rear illuminated panel 20 includes a sheet of thermoplastic material 38, such as Plexiglas, that is clear. As with other embodiments herein, the thermoplastic material 38 is adapted for writing thereon with a dry erase marker or other similar writing implement. In addition, in this embodiment, the base member 22 is preferably an aluminum extrusion with a mill finish and the LEDs 52 of the LED strip 50 are red, green, blue, white, and/or multi-colored (e.g., a tri-color LED of red/green/blue). The LEDs 52 may be controlled by a wall mount dimming switch 92, which is not programmable. Optionally, a controller, such as a DMX controller, may be connected to a light board, for controlling operation of the LEDs. With an additional controller and/or a DMX controller and use of multi-colored LEDs, millions of different colors can be created.

Referring to FIGS. 8-14, the rear illuminated panel 20 of this embodiment is attached to a support structure, in particular, an index light 100. Specifically, the index light 100 includes a plurality of generally horizontal T-beams 102 held in place by multiple additional beams, including a plurality of diagonal beams 104, each set of T-beams 102 and diagonal beams 104 spaced a distance apart, for example, between 5 and 8 feet. The index light 100 further includes an L-shaped panel 106 and an elongate bracket 108 that are attached to one another and the T-beams 102. In particular, the bracket 108 includes a first end 110 that curves inwardly and downwardly to form a generally cylindrical cavity 112 for holding a pipe 114 or other elongate tubular structure or structures. A central portion 116 of the bracket 108 is generally planar and a second end 118 of the bracket 108 includes a downwardly and inwardly extending portion 120 that is attached to a T-beam 102 by one or more bolts 122 or other attachment mechanisms. The L-shaped panel 106 includes a first, longer portion 130 that extends downwardly from the index light 100 and a second, shorter portion 132 that is attached by bolts 134 or other attachment mechanisms to the bracket 108. A first side 136 of an L-shaped bracket 138 is also attached to the bracket 108 by one or more bolts 140 or other attachment mechanisms, wherein a second side 142 of the bracket 138 prevents movement of the L-shaped panel 106.

Figure 9:
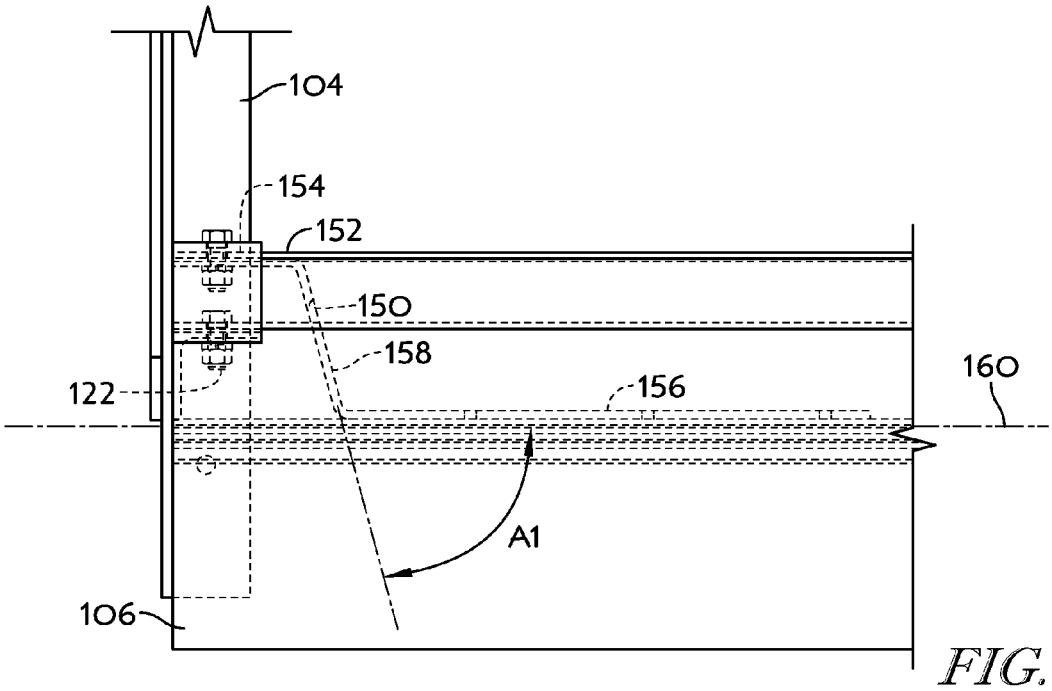
FIG. 9 is an enlarged view (see section 7 of FIG. 6) showing how the rear illuminated panel is attached to the support structure at an end of the support structure.
Figure 12:
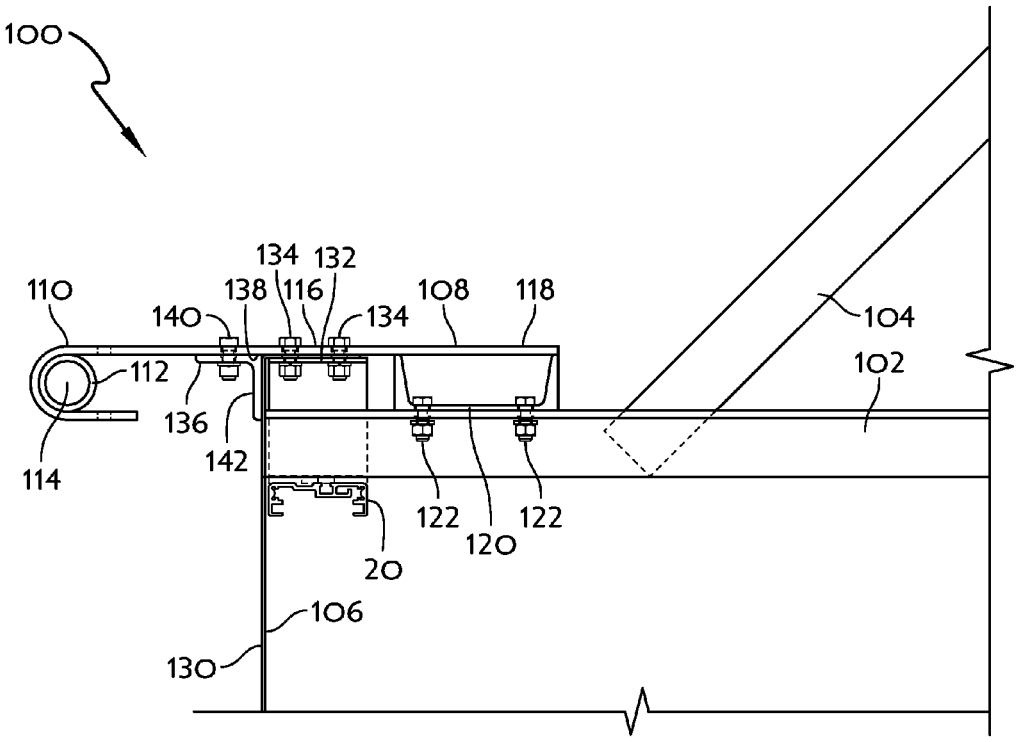
FIG. 12 is an enlarged view (see section 10 in FIG. 11) detailing an area where the rear illuminated panel is attached to the support structure.
Figure 13:
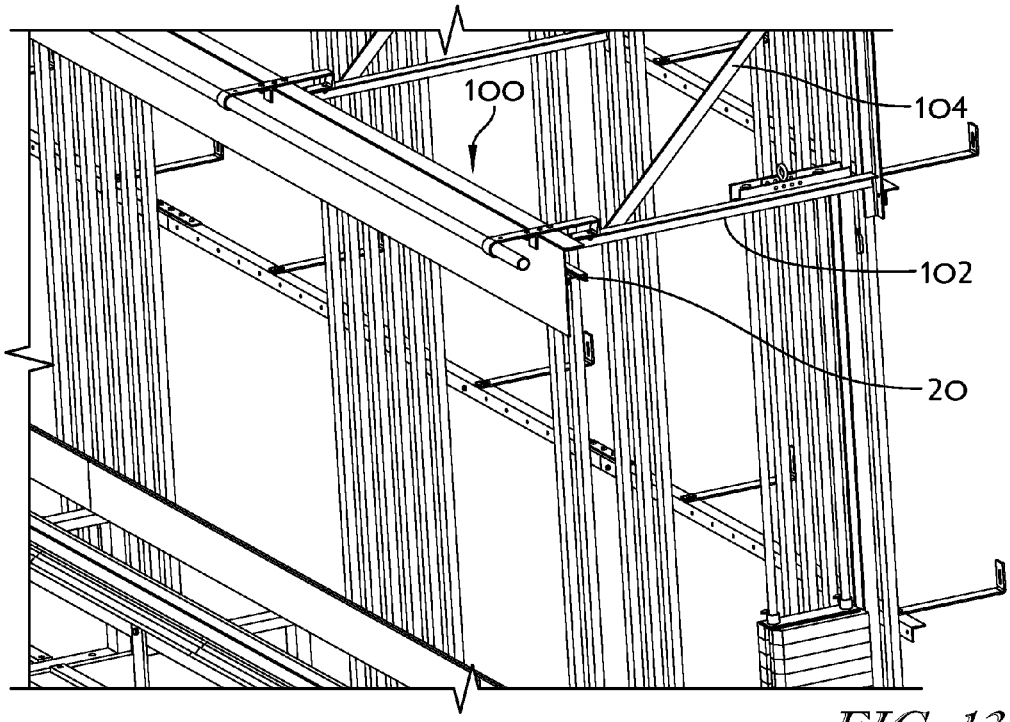
FIG. 13 is a view of the rear illuminated panel attached to the support structure (index light) of FIG. 8.
Figure 14:
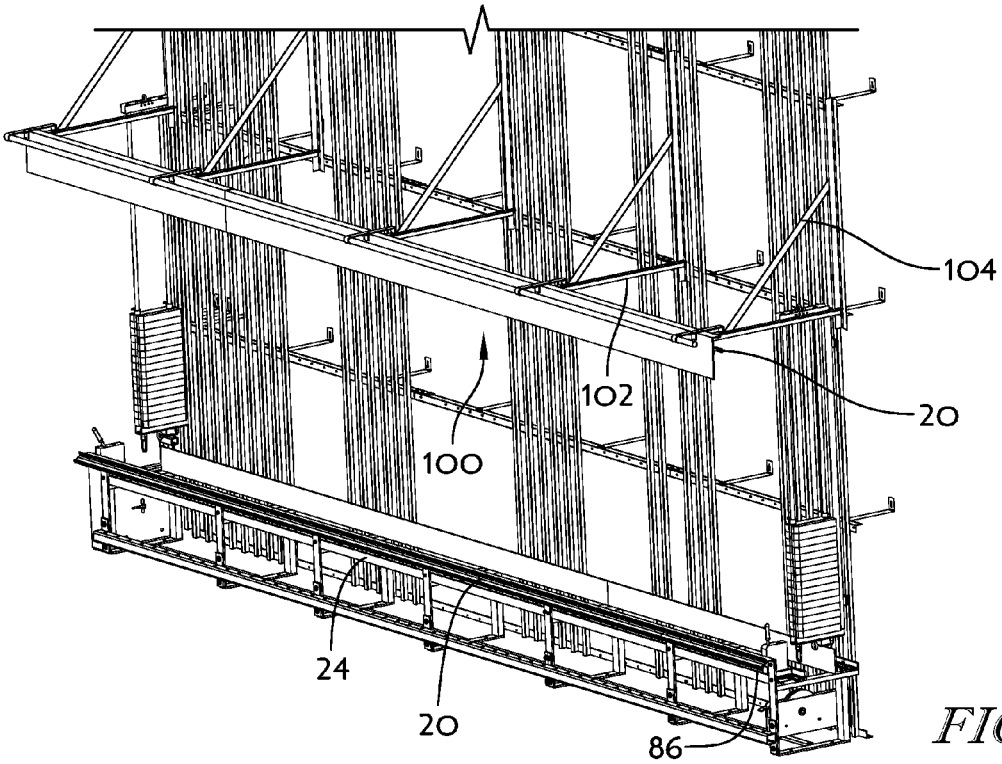
FIG. 14 is a view depicting the rear illuminated panels as seen in FIGS. 7 and 13.

As best seen in FIG. 12, the illuminated panel 20 is attached by an end bracket 150 to a lower surface 152 of the elongate bracket 108 by the bolts 134. Specifically, the bolts 134 attach the shorter portion 132 of the panel 106, the elongate bracket 108, and the bracket 150. Referring to FIG. 9, at ends of the index light 100, the brackets 150 include first and second planar portions 154, 156 connected by an angled portion 158. The first planar portion 154 is attached at the bolts 134 to the short portion 132 of the panel 106 and the elongate bracket 108 and the second planar portion 156 is attached to the illuminated panel 20 in any fashion known in the art. An angle A1 formed by the angled portion 154 with respect to a longitudinal axis 160 of the index light 100, wherein A1 is between about 45 degrees and about 60 degrees. End brackets 150 are disposed at ends of the index light 100.

Figure 10:
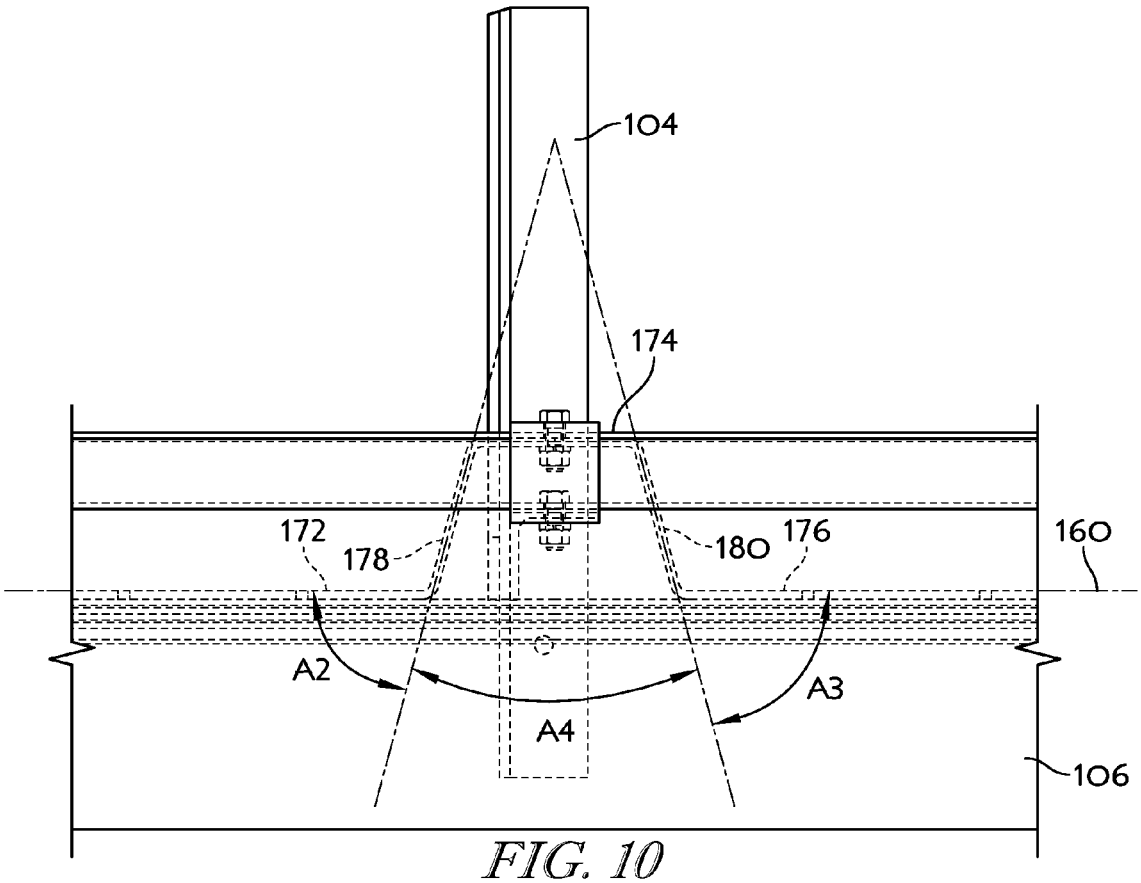
FIG. 10 is an enlarged view (see section 8 of FIG. 6) showing how the rear illuminated panel is attached to the support structure at center portions of the support structure.
Figure 11:
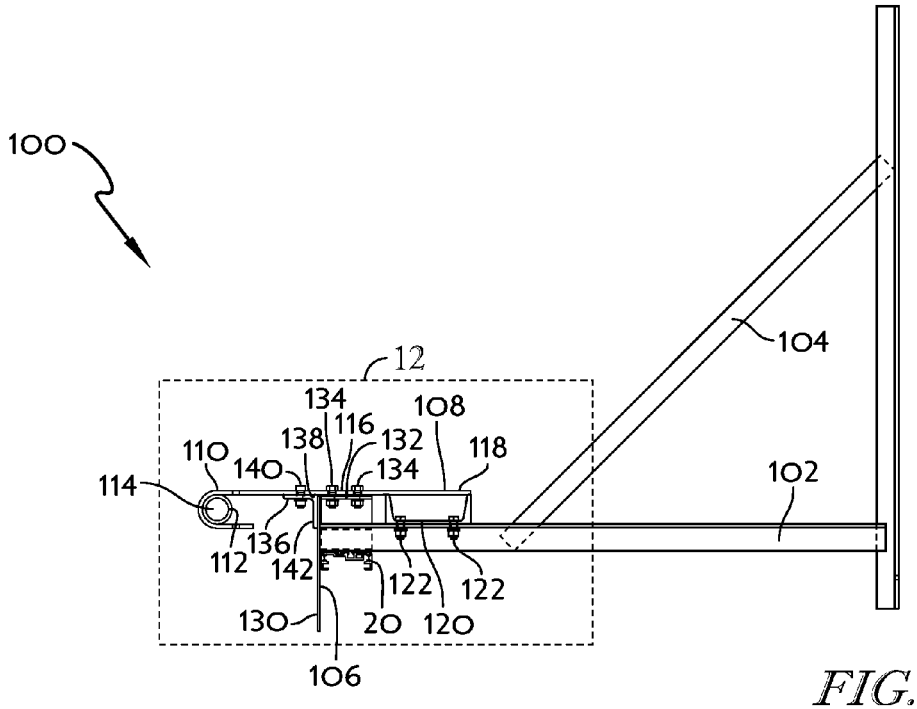
FIG. 11 is a side elevational view of the rear illuminated panel attached to the index light of FIG. 8.

Central brackets 170 are utilized between ends of the index light 100 to attach the illuminated panel 20 to the index light 100, as seen in FIG. 10. In particular, the central brackets 170 include first, second, and third planar portions 172, 174, 176, wherein the first and second planar portions 172, 174 are separated by a first angled portion 178 and the second and third planar portions 174, 176 are separated by a second angled portion 180. The first and third planar portions 172, 176 are attached to the illuminated panel 20 in any fashion known in the art and the second planar portion 174 is attached at the bolts 134 to the short portion 132 of the panel 106 and the elongate bracket 108. Angles A2 and A3 are formed by the angled portions 178, 180 with respect to the longitudinal axis 160, wherein A2 and A3 are about 75 degrees. While A2 and A3 are shown as being similar, A2 and A3 may be different. In addition, an angle A4 of about 30 degrees is formed between the angled portions 178, 180 of the central bracket 170.

Figure 15:
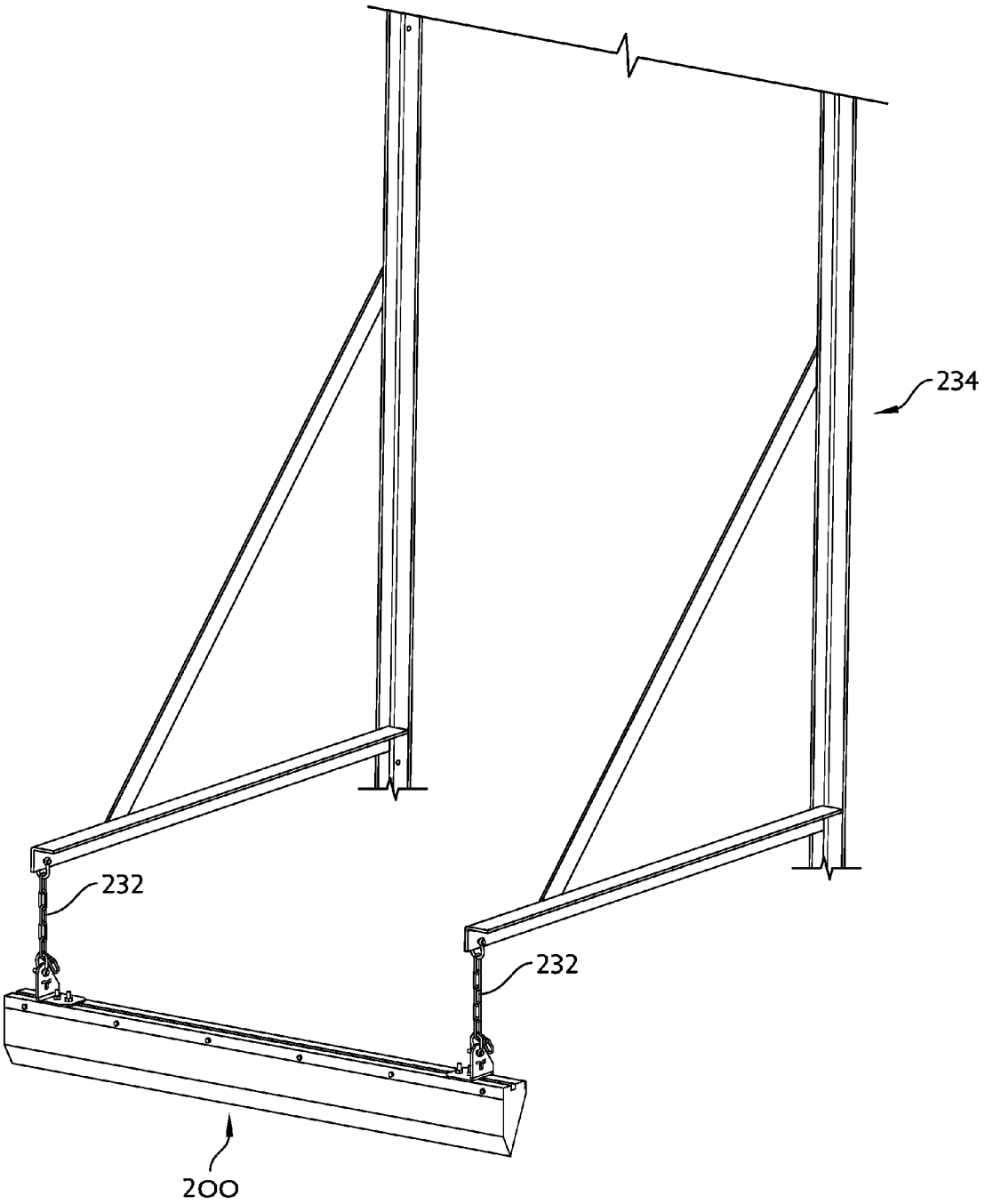
FIG. 15 is a top and front isometric view of an index light of the present disclosure suspended from a support structure.
Figure 16:
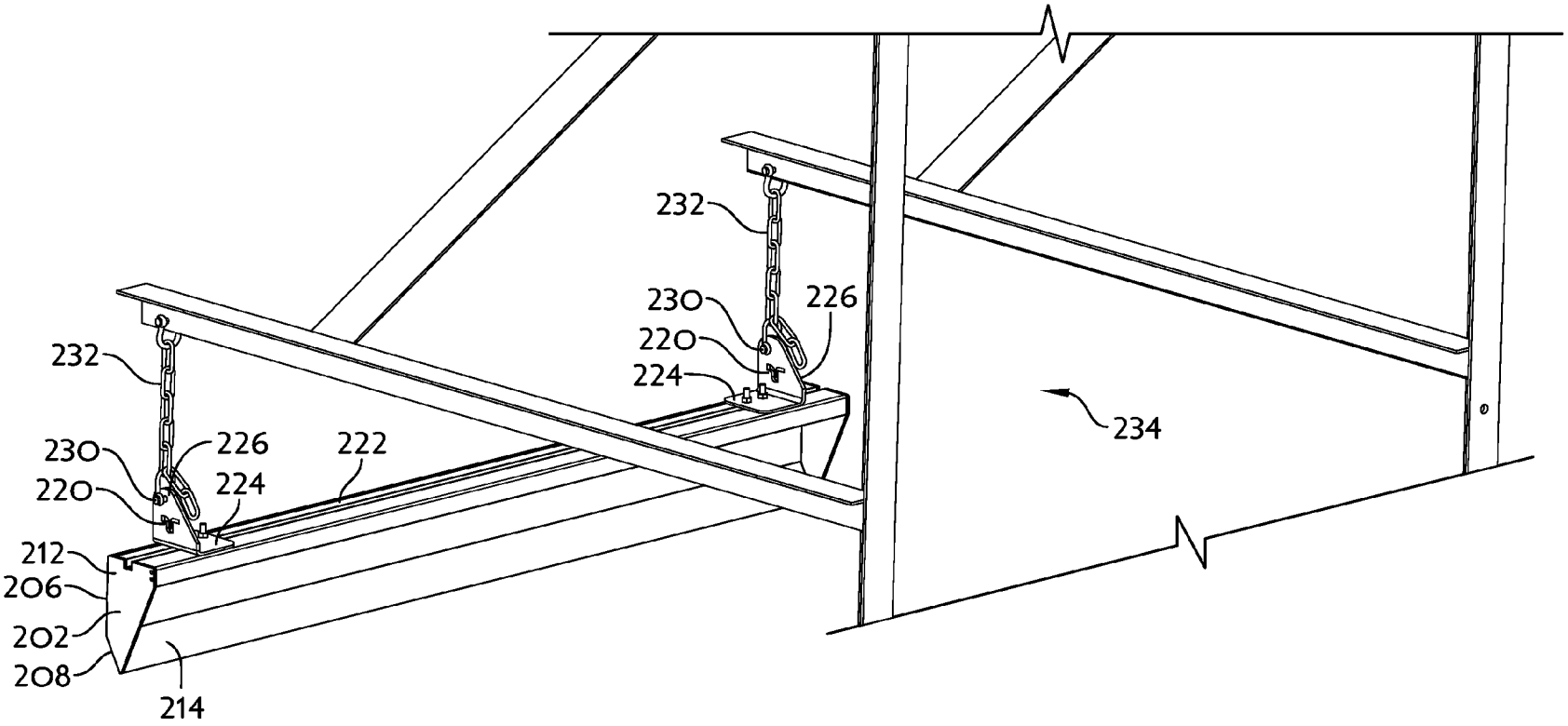
FIG. 16 is an enlarged top and rear isometric view of the index light of FIG. 15.
Figure 17:
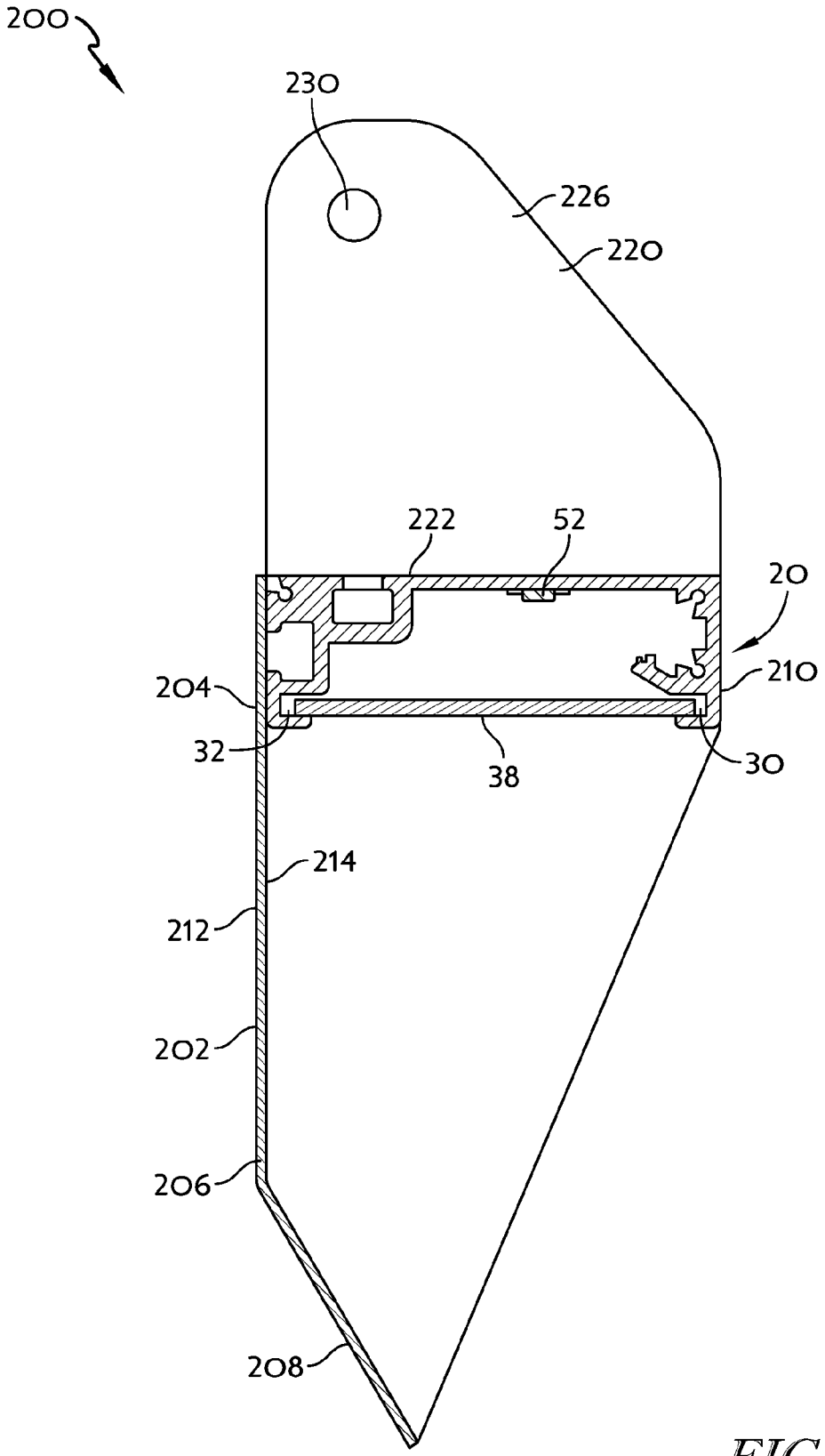
FIG. 17 is a cross sectional view of the index light of FIG. 15 taken generally along the lines 17-17 of FIG. 16.

FIGS. 15-17 depict an index light 200 incorporating a rear illuminated panel 20 similar to that disclosed in FIGS. 3-6. The index light 200 further includes a light directing wall 202 extending from a first side 204 of the light 200 and having a first generally vertical segment 206 and a second segment 208 that is angled toward a second side 210 of the light 200. An outer side 212 of the wall 202 is preferably black to blend in with dark scenery and an inner side 214 of the wall 202 is preferably white to reflect light emitted by the LEDs 52. The second segment 208 of the wall 202 is angled rearwardly to transmit reflected light rearwardly, rather than downwardly. The index light 200 further includes at least two attachment mechanisms 220 attached to and extending upwardly from an outer or upper surface 222 of the rear illuminated panel 20. As best seen in FIG. 16, each attachment mechanism 220 is comprised of an L-shaped bracket having a first planar segment 224 that is attached by screws, bolts, or any other known attachment means to the outer surface 222 of the rear illuminated panel 20. Each attachment mechanism 220 further includes a second segment 226 that is generally vertical and generally transverse to the first planar segment 224. The second segment 226 includes a slot, aperture, or other connecting member 230 for attaching a chain 232 for connecting the attachment mechanism 220 and a structure 234 from which the index light 20 is to be suspended. The chain 232 may be adjustable in height and/or may be replaced by any other support mechanism known in the art. As described above, the index light 200 may be made in any length in that the rear illuminated panel 20 is modular. In addition, the additional components necessary for the index light 200 may be modular.

Figure 18:
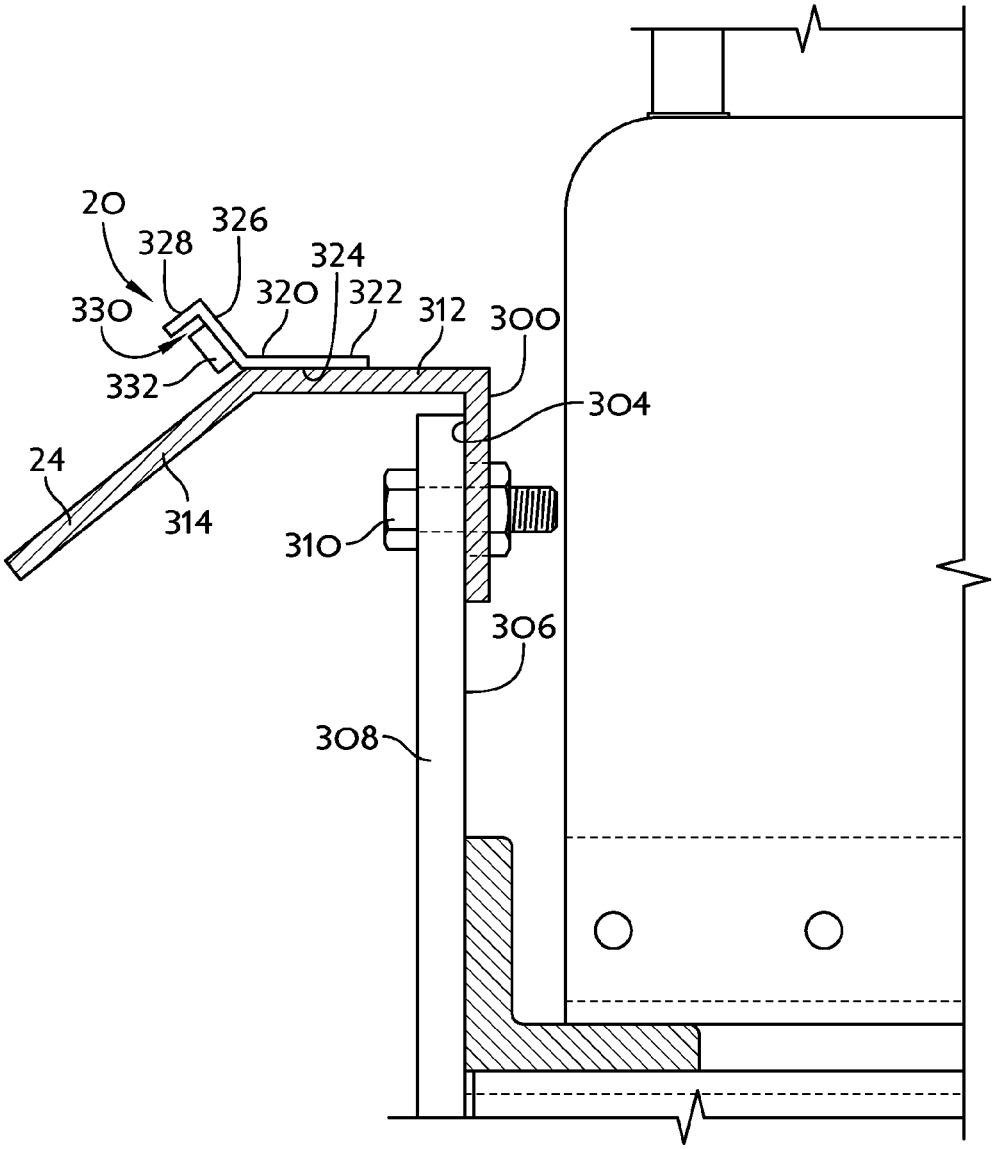
FIGS. 18 and 19 are a further embodiments of an illuminated panel.

FIG. 18 depicts an illuminated panel 20 attached to a support structure 24, such as an index strip or a locking rail. The support structure 24 includes a first generally vertical panel 300 having an inner surface 304 that is attached to an outer surface 306 of a beam or other support 308 by a bolt or other attachment mechanism 310. A generally horizontal panel 312 extends outwardly from the vertical panel 300 past the beam 308 and a diagonal panel 314 extends outwardly and downwardly from the horizontal panel 312. The illuminated panel 20 includes a housing 320 with a generally horizontal portion 322 with a lower surface 324 attached to the horizontal panel 312 of the support structure 24. The housing 320 further includes an angled portion 326 that extends away from the horizontal portion 322 and the diagonal panel 314 of the structure 24 and a lip 328 that, together with the angled portion 326 and the diagonal panel 314, form a cavity 330. One or more LEDs 332 are disposed within the cavity 330 for illuminating downwardly along the diagonal panel 314. Index cards may be utilized with this embodiment, wherein the LEDs 332 provide illumination for viewing the index cards.

Figure 19:
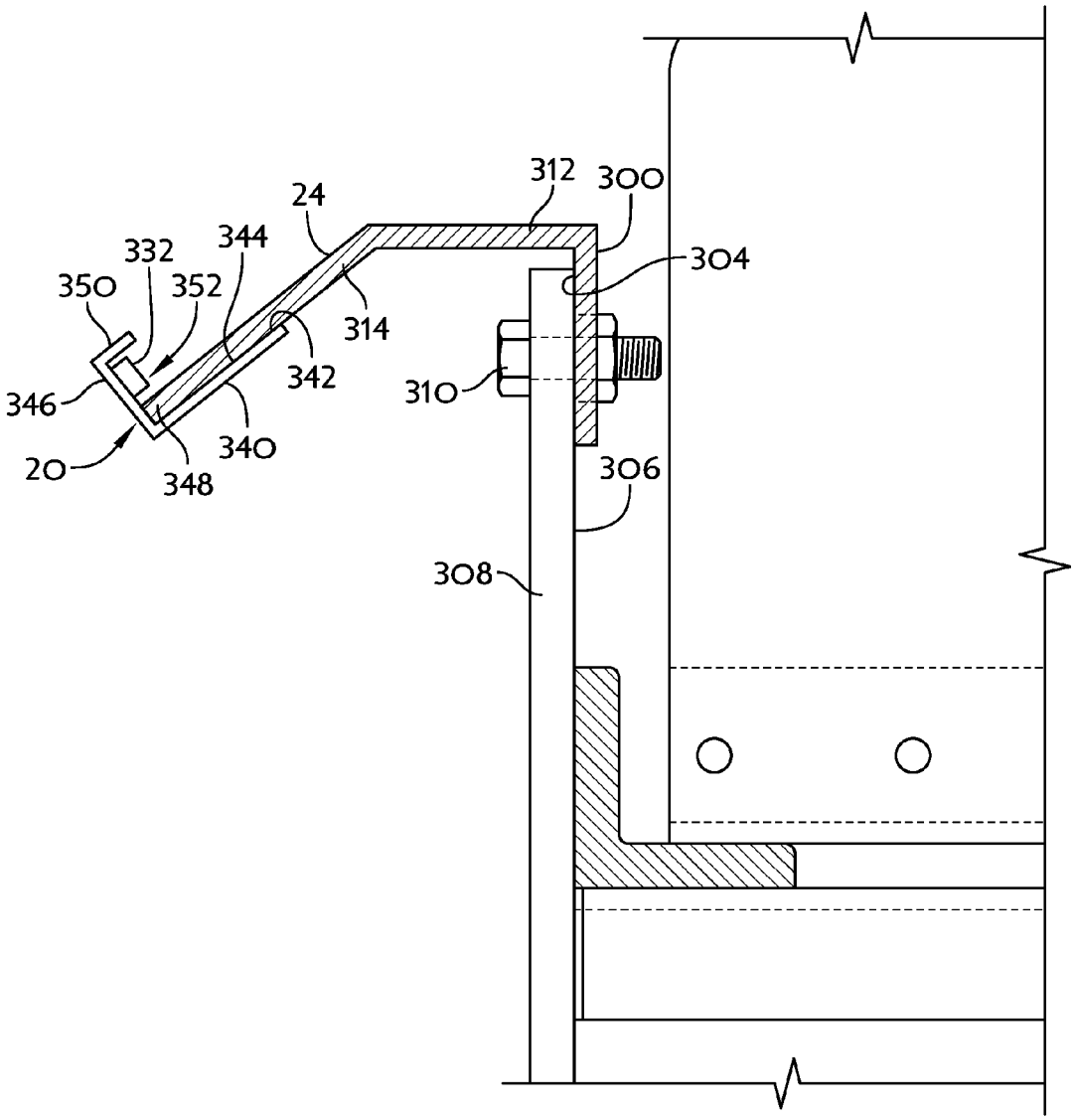

The embodiment an illuminated panel 20 of FIG. 19 is similar to the embodiment of FIG. 18, and thus only the differences will be discussed. The illuminated panel 20 includes a first diagonal portion 340 having an upper surface 342 secured to a rear surface 344 of the diagonal panel 314 of the structure 24. The illuminated panel 20 includes a second diagonal portion 346 generally perpendicular to the first diagonal portion 340 and which abuts a lower end 348 of the diagonal panel 314. A lip 350 extends inwardly of the second diagonal portion 346 and is generally parallel to the first diagonal portion 340. The lip 350, the second diagonal portion 346, and the diagonal panel 314 form a cavity 352 that houses one or more LEDs 332 that shine light upwardly along the diagonal panel 314. Again, index cards may be utilized with this embodiment.

The illuminated panels 20 as disclosed herein are modular in nature. In particular, each panel 20 may be provided in, for example 8 or 10 foot segments. As one skilled in the art would recognize, any size segments may be utilized and/or multiple different size segments may be provided without departing from the scope of the present invention. Each segment would be provided, for example, in the form seen in FIGS. 3 and 4.

If a user desires to create a rear illuminated panel 20 using two segments, adjacent end caps 60 may be removed and one or more connectors may be utilized to connect the panels 20. Any connector may be utilized, for example, one or more clips, screws, bolts, an adhesive, tape, or combinations thereof. Optionally, one or more connectors may be formed in the shape of the grooves 30, 32 (or any other grooves within the base member 22, wherein the connector is slid into the grooves of adjacent panels 20 to retain the panels 20 adjacent one another. In such arrangement, one or more retaining means may be utilized to retain the connector in place within the base member 22.

The modular rear illuminated panels 20 provide a compact, portable, and adjustable illuminated panel for use in almost any environment. Prior art panels are bulky, hard to move and manipulate, and do not provide adjustability.

Any of the embodiments described herein may be modified to include any of the structures or methodologies disclosed in connection with other embodiments.

Further, although directional terminology, such as front, back, upper, lower, etc. may be used throughout the present specification, it should be understood that such terms are not limiting and are only utilized herein to convey the orientation of different elements with respect to one another.

Numerous modifications to the present disclosure will be apparent to those skilled in the art in view of the foregoing description. Accordingly, this description is to be construed as illustrative only and is presented for the purpose of enabling those skilled in the art to make and use the embodiments of the present disclosure and to teach the best mode of carrying out same. The exclusive rights to all modifications which come within the scope of the appended claims are reserved.

The invention claimed is:

1. An illuminated panel, comprising:

a base member having first and second opposing sides;

a pair of grooves formed on the first side of the base member;

a translucent thermoplastic sheet of material having rubber channel strips on opposing longitudinal sides of the sheet of material, the sheet of material being disposed within the guide grooves of the base member such that channel strips prevent vibration of the sheet of material within the guide grooves; and an LED strip having a plurality of LEDs and disposed within a cavity formed by the base member and the sheet of material, wherein light from the LEDs illuminates the sheet of material;

wherein the second opposing side of the base panel is adapted to be fastened to a structure.

2. The illuminated panel of claim 1, wherein the illuminated panel is fastened to a structure selected from the group consisting of a locking rail and an index light.

* * * * *